US006977566B2

(12) United States Patent
Fukunaga

(10) Patent No.: US 6,977,566 B2
(45) Date of Patent: Dec. 20, 2005

(54) FILTER AND METHOD OF ARRANGING RESONATORS

(75) Inventor: Tatsuya Fukunaga, Chuo-ku (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 10/773,167

(22) Filed: Feb. 9, 2004

(65) Prior Publication Data

US 2004/0155732 A1 Aug. 12, 2004

(30) Foreign Application Priority Data

Feb. 12, 2003 (JP) ..... 2003-033705

(51) Int. Cl.[7] ..... H01P 1/208
(52) U.S. Cl. ..... 333/208; 333/212
(58) Field of Search ..... 333/212, 208, 333/239, 248, 134

(56) References Cited

U.S. PATENT DOCUMENTS 4,216,448 A * 8/1980 Kasuga et al. ..... 333/203
4,246,555 A 1/1981 Williams
4,772,863 A * 9/1988 Rosenberg et al. ..... 333/212
5,398,009 A * 3/1995 Kudo et al. ..... 333/208
5,936,490 A * 8/1999 Hershtig ..... 333/202
6,611,183 B1 * 8/2003 Peters ..... 333/206
6,791,438 B2 * 9/2004 Takahashi et al. ..... 333/208

FOREIGN PATENT DOCUMENTS

JP 11284409 A * 10/1999 ..... H01P 1/207
JP A 2002-26611 1/2002
JP A 2002-43807 2/2002

OTHER PUBLICATIONS

Ito et al., Masaharu, "A 60 GHZ-Band Planar Dielectric Waveguide Filter For Flip-Chip Modules", IEEE MTT-S Digest, vol. TH2B-6, pp. 1597-1600, 2001.

* cited by examiner

*Primary Examiner*—Seungsook Ham
(74) *Attorney, Agent, or Firm*—Oliff & Berridge, PLC

(57) ABSTRACT

Provided are a filter and a method of arranging resonators, which enable forming an attenuation pole and thus achieving excellent frequency characteristics. The filter includes a plurality of resonators. An electromagnetic wave enters through an input end into one of the resonators and exits through an output end from another resonator. The resonators are arranged so that two propagation paths are formed between the input end of one resonator and the output end of another resonator. Forming a plurality of propagation paths allows producing the attenuation pole.

11 Claims, 10 Drawing Sheets

FILTER AND METHOD OF ARRANGING RESONATORS

BACKGROUND OF THE INVENTION

1. Field of the Invention

The invention relates to a filter designed for signals in a band of high frequencies such as microwaves or millimeter waves, and a method of arranging resonators which constitute the filter.

2. Description of the Related Art

In the field of communications, filters intended for signals in a band of high frequencies such as microwaves or millimeter waves have been heretofore developed. As the types of such filters, there are known, for example, a waveguide filter, a waveguide-type dielectric filter, and the like.

FIG. 11 shows a configuration of a conventional waveguide filter. The waveguide filter includes a wiring board 110, and a plurality of resonators 101 to 105 each comprising a waveguide, which are arranged in series on the wiring board 110. A signal input 111 and a signal output 112 are provided on one and the other ends, respectively, of the wiring board 110. The resonators 101 to 105 are arranged between the signal input 111 and the signal output 112.

FIG. 12 shows coupling of the resonators 101 to 105 of the waveguide filter. In the waveguide filter, the resonators 101 to 105 are electromagnetically coupled in series, and the adjacent resonators 101 and 102, 102 and 103, 103 and 104, and 104 and 105 have coupling coefficients of k12, k23, k34, and k45, respectively. The waveguide filter allows the passage of signals in a band of resonance frequencies of the resonators 101 to 105 electromagnetically coupled, and reflects signals outside this band.

The prior arts of the filter including a plurality of resonators connected in series as mentioned above include filters disclosed in Japanese Unexamined Patent Application Publication No. 2002-43807 and Japanese Unexamined Patent Application Publication No. 2002-26611, for example. Japanese Unexamined Patent Application Publication No. 2002-43807 discloses an example of a waveguide-type dielectric filter, which includes a dielectric block in the shape of a rectangular parallelepiped including a plurality of resonant elements, and a wiring board having the dielectric block mounted thereon. Japanese Unexamined Patent Application Publication No. 2002-26611 discloses an example of a dielectric filter having a configuration in which through holes are used as a sidewall of a waveguide.

Recently, frequencies of signals for use in communications equipment have become increasingly higher, and a filter having excellent frequency characteristics has been also desired. Thus, for example to implement a band-pass filter which allows the passage of a specific frequency band alone, an attenuation pole (i.e., a trap) can be formed in a range other than a pass band so as to improve attenuation characteristics. For instance when two signal propagation paths 121 and 122 are connected in parallel between the signal input 111 and the signal output 112 as shown in FIG. 13, a phase difference of $\pi$ arising between the two propagation paths 121 and 122 allows electromagnetic waves to cancel each other out, thus forming the attenuation pole. However, the conventional waveguide filter has a structure including the waveguides connected in series as shown in FIG. 11, not a structure adapted to form a plurality of propagation paths, so that the filter cannot produce the attenuation pole.

SUMMARY OF THE INVENTION

The invention is designed to overcome the foregoing problems. It is an object of the invention to provide a filter and a method of arranging resonators, which enable forming an attenuation pole and thus achieving excellent frequency characteristics.

A filter of the invention includes three or more resonators each comprising a waveguide having an electromagnetic wave propagation region surrounded by conductors, the resonators are arranged so that an electromagnetic wave enters through an input end into one of the resonators and exits through an output end from another resonator, and the resonators are arranged so that a plurality of propagation paths are formed between the input end and the output end.

A method of arranging three or more resonators of the invention, each of which comprises a waveguide having an electromagnetic wave propagation region surrounded by conductors, includes arranging the resonators so that an electromagnetic wave enters through an input end into one of the resonators and exits through an output end from another resonator, and arranging the resonators so that a plurality of propagation paths are formed between the input end and the output end.

In the filter of the invention or the method of arranging resonators of the invention, three or more resonators each comprise the waveguide having the electromagnetic wave propagation region surrounded by the conductors. The resonators are arranged so that the electromagnetic wave enters through the input end into one of the resonators and exits through the output end from another resonator, and the resonators are arranged so that a plurality of propagation paths are formed between the input end and the output end. Forming a plurality of propagation paths allows forming an attenuation pole.

In the filter of the invention, the electromagnetic wave propagation region may be made of a dielectric or may have a cavity structure. The resonators may be arranged in two dimensions along a plane containing the input end and the output end.

The filter of the invention may be configured in the following manner: for example, the filter includes at least three resonators arranged adjacent to one another, and a plurality of adjacent resonators are arranged in the general shape of the letter Y. In this case, the boundaries of the adjacent resonators have the general shape of the letter Y, for example.

The filter of the invention may have the following structure: for example, each of the resonators has two conductive layers facing each other and sidewalls formed between the two conductive layers so that an electromagnetic wave propagates through a region formed by the two conductive layers and the sidewalls, and the sidewalls of some or all of the resonators have branched structures so that a plurality of resonators are coupled at the branched parts.

In this case, the sidewalls of the resonators having the branched structures may have the shape of the letter Y, for example. The sidewalls of the resonators may be formed by through holes through and between the conductive layers. The sidewalls of the resonators may be formed by a continuous conductive wall.

Other and further objects, features and advantages of the invention will appear more fully from the following description.

DETAILED DESCRIPTION OF THE PREFERRED EMBODIMENTS

Embodiments of the invention will be described in detail below with reference to the drawings.

Figure 1:
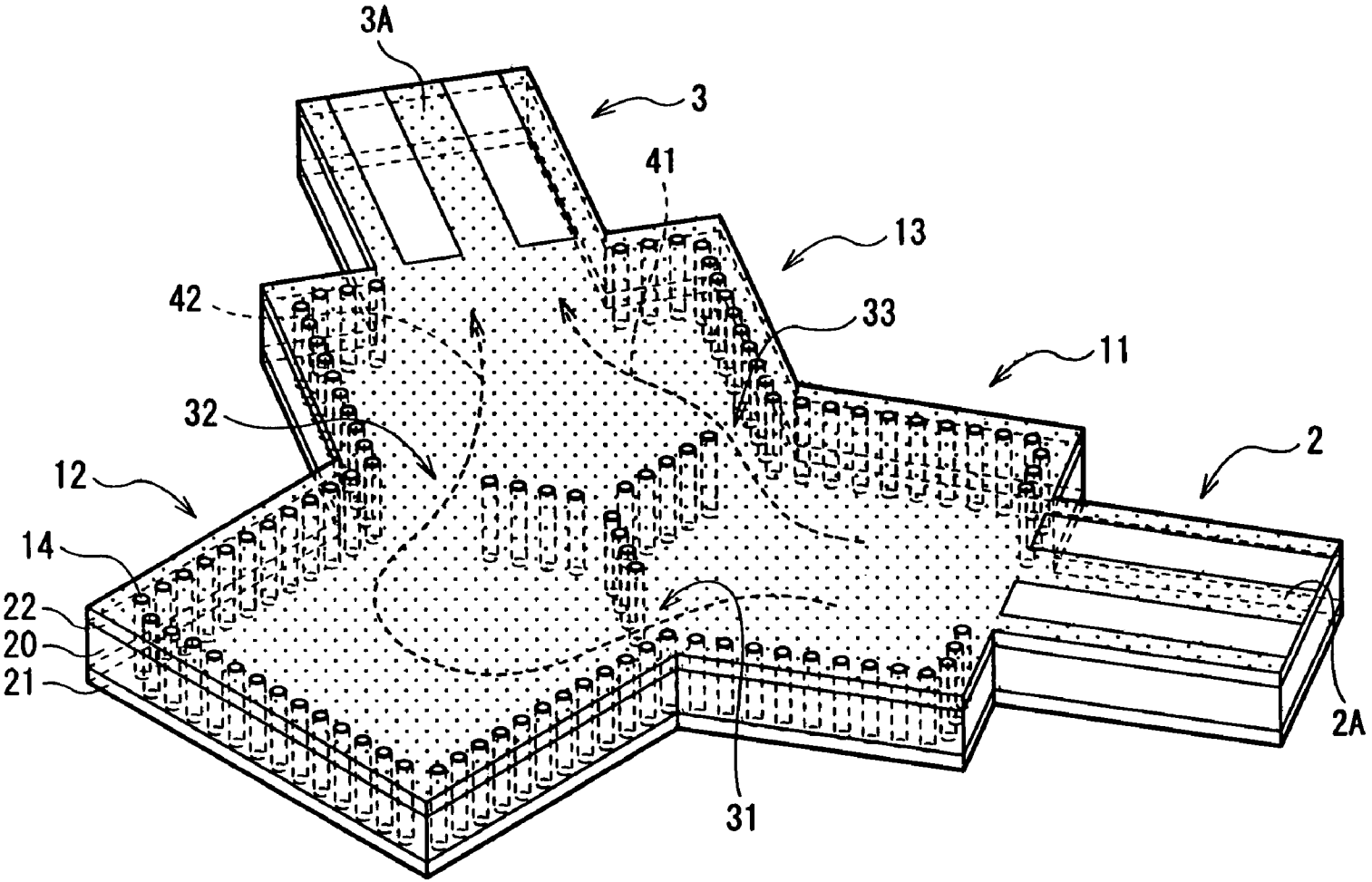
FIG. 1 is a perspective view showing a configuration of a filter according to one embodiment of the invention.

FIG. 1 shows a configuration of a filter according to one embodiment of the invention. The filter can be used as, for example, an RF filter, and is mounted on, for instance, an MMIC (i.e., a monolithic microwave integrated circuit) or the like for use.

The filter includes a plurality of resonators 11 to 13, and a signal input 2 and a signal output 3. The signal input 2 and signal output 3 are integrally formed with the resonators 11 to 13. An input end 11A of the first resonator 11 (see FIG. 2A) is connected to the signal input 2, and an output end 13A of the third resonator 13 (see FIG. 2A) is connected to the signal output 3. The resonators 11 to 13 are arranged in two dimensions along a plane containing the input end 11A of the first resonator 11 and the output end 13A of the third resonator 13.

Each of the signal input 2 and signal output 3 has a dielectric substrate 20, and conductive layers 21 and 22 facing each other with the dielectric substrate 20 in between. Each of the signal input 2 and signal output 3 can include a coplanar line which allows the propagation of an electromagnetic wave in TEM mode, for example. In this case, a region containing no conductor is formed partly on each of the top conductive layers 22 of the signal input 2 and signal output 3, and line patterns 2A and 3A are formed on the nonconductive regions of the signal input 2 and signal output 3, respectively. The signal input 2 is connected to the end surface of the resonator 11 in the direction in which the line pattern 2A extends, and the signal output 3 is connected to the end surface of the resonator 13 in the direction in which the line pattern 3A extends. The resonators 11 and 13 are adapted to allow the propagation of an electromagnetic wave in, for example, TE mode, and the electromagnetic wave undergoes conversion from TEM mode into TE mode when propagating from the signal input 2 to the resonator 11, and undergoes conversion from TE mode into TEM mode when propagating from the resonator 13 to the signal output 3. Incidentally, the structures of the signal input 2 and signal output 3 and the structures of connections between the signal input 2 and signal output 3 and the resonators 11 and 13 are not limited to the illustrative structures but may be other structures using other general techniques which have been heretofore available.

Each of the resonators 11 to 13 has the dielectric substrate 20 and the conductive layers 21 and 22, and a plurality of through holes 14 through and between the conductive layers 21 and 22. An inner surface of the through hole 14 is metallized. The cross-sectional configuration of the through hole 14 is not limited to a circular shape but may have other shapes such as a polygonal shape or an oval shape. The through holes 14 are spaced at intervals of a predetermined or lower value (e.g., a quarter or less of a signal wavelength) so as to prevent a propagating electromagnetic wave from leaking out, and the through holes 14 function as pseudo conductive walls.

The resonators 11 to 13 each comprise a waveguide formed by the conductive layers 21 and 22 and the through holes 14 so that an electromagnetic wave propagates in, for example, TE mode through a region surrounded by the conductive walls formed by the conductive layers 21 and 22 and the through holes 14. Each of the resonators 11 to 13 may comprise a dielectric waveguide having the electromagnetic wave propagation region filled with a dielectric, or may comprise a cavity waveguide having a cavity therein.

The dimensions of each of the resonators 11 to 13 (e.g., the length of the waveguide constituting the resonator, etc.) are appropriately set according to required filter characteristics (e.g., a band of resonance frequencies, etc.). Thus, the lengths of sides (i.e., the lengths of sidewall portions) generally vary among the resonators 11 to 13.

Figure 2A:
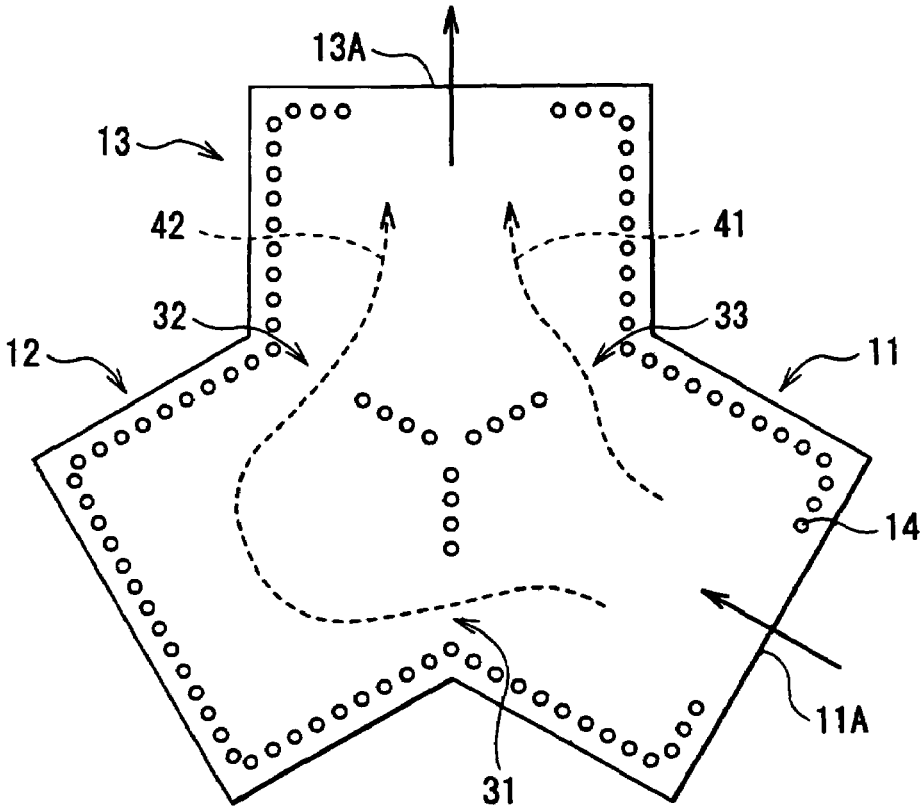
FIGS. 2A and 2B are schematic illustrations for explaining the coupling of resonators of the filter shown in FIG. 1.
Figure 2B:
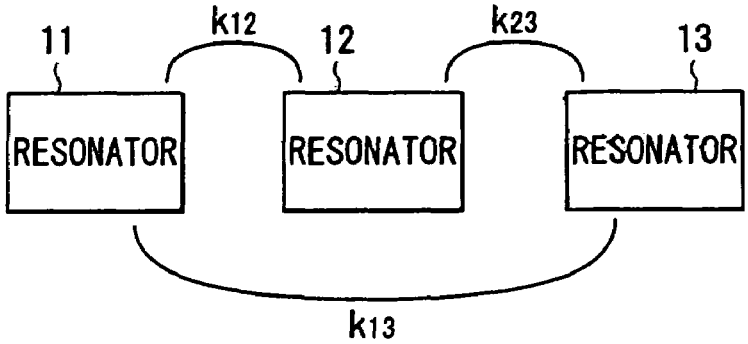

FIGS. 2A and 2B are illustrations for explaining the coupling and arrangement of the resonators 11 to 13. FIG. 2A is a schematic illustration of the arrangement and coupling of the resonators 11 to 13, not a strict illustration of the structures of the resonators 11 to 13.

As also shown in FIG. 2A, the resonators 11 to 13 are arranged adjacent to one another, and the adjacent resonators 11 to 13 are arranged in the general shape of the letter Y. Moreover, each of the resonators 11 to 13 has a branched structure in a part of the sidewall formed by the through holes 14, and one resonator is coupled to the other resonators at the branched part. The sidewalls of the resonators 11 to 13 having the branched structures (i.e., the boundaries of the resonators 11 to 13) have the general shape of the letter Y, for example. In the parts having the branched structures (i.e., the coupling portions of the resonators), there are provided coupling windows 31 to 33, and the resonators 11 to 13 are electromagnetically connected to one another through the coupling windows 31 to 33. The coupling windows 31 to 33 are formed by eliminating the formation of the through holes 14.

As shown in FIG. 2B, in the filter, the first resonator 11 is electromagnetically coupled to the second and third resonators 12 and 13 with coupling coefficients of k12 and k13, respectively. The second resonator 12 is electromagnetically coupled to the first and third resonators 11 and 13 with coupling coefficients of k12 and k23, respectively.

Adjustment of the strength of coupling of the resonators 11 to 13 or the like can be accomplished by changing the positions or sizes of the coupling windows 31 to 33. Adjustment of coupling using the coupling windows 31 to 33 allows control of an attenuation pole, as will be described later. Two or more coupling windows 31 to 33 may be provided between the adjacent resonators. For example, a plurality of coupling windows 33 may be provided between the first and third resonators 11 and 13.

The resonators 11 to 13 are coupled through the above-described branched structures, so that two signal propagation paths are formed in the filter. More specifically, a first path 41 is formed by the first and third resonators 11 and 13, and a second path 42 is formed by the first, second and third resonators 11, 12 and 13. Thus, an electromagnetic wave signal travels in the following manner: the signal is inputted to the signal input 2 and enters through the input end 11A into the first resonator 11, propagates through the resonators along the two propagation paths 41 and 42, and exits through the output end 13A from the third resonator 13 and is outputted as a common signal from the signal output 3.

Next, the description is given with regard to the function of the filter configured as described above.

In the filter, an electromagnetic wave signal is inputted to the signal input 2 and enters through the input end 11A into the first resonator 11. The inputted electromagnetic wave signal propagates through the resonators along the two propagation paths 41 and 42. More specifically, the signal propagates through the first and third resonators 11 and 13 in this order along the first path 41. The signal also propagates through the first, second and third resonators 11, 12 and 13 in this order along the second path 42. Each of the resonators 11 to 13 allows the passage of signals in a band of resonance frequencies according to the structure of each resonator, and reflects signals outside this band. After propagating through the resonators along the two propagation paths 41 and 42, the electromagnetic wave signal exits through the output end 13A from the third resonator 13 and is outputted from the signal output 3.

In the filter, the presence of the two propagation paths 41 and 42 causes a phase difference between electromagnetic waves propagating along the propagation paths 41 and 42. The occurrence of a phase difference of $\pi$ allows the electromagnetic waves to cancel each other out, thus forming an attenuation pole.

Figure 3:
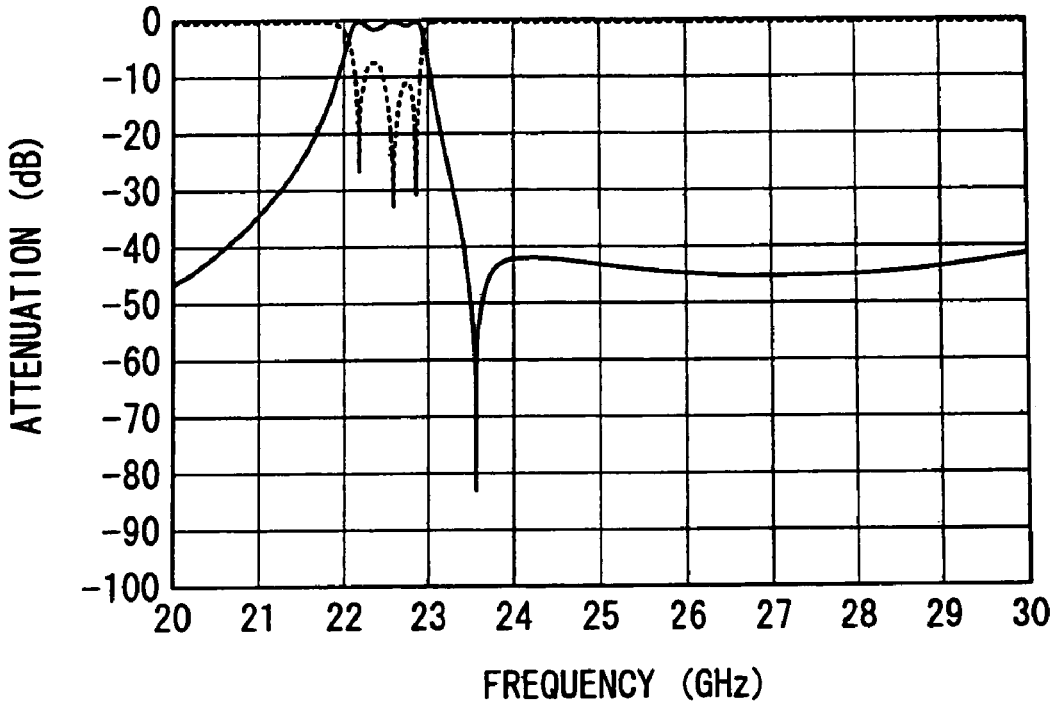
FIG. 3 is a plot showing frequency characteristics of the filter shown in FIG. 1.

FIG. 3 shows an example of actual frequency characteristics of the filter. The solid line indicates signal pass characteristics, and the dotted line indicates signal reflection characteristics. The vertical axis represents attenuation (dB), and the horizontal axis represents frequencies (GHz). In this example, a pass band of frequencies lies between about 22 and 23 GHz. It can be also seen that an acute attenuation pole is formed at a higher frequency (of about 23.6 GHz) than this pass band of frequencies.

Figure 4:
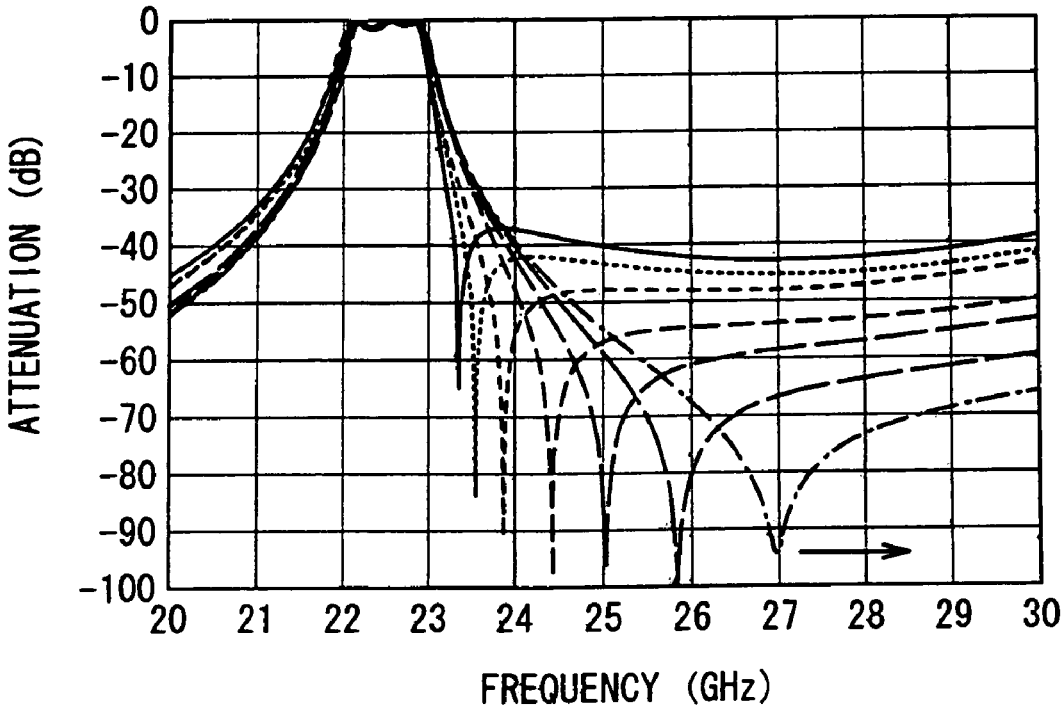
FIG. 4 is a plot for explaining a method of controlling an attenuation pole produced by the filter shown in FIG. 1.

The description is now given with regard to a method of controlling an attenuation pole. FIG. 4 shows frequency characteristics which appear when the filter has varying degrees of coupling using the coupling windows 31 to 33. In more detail, there are shown frequency characteristics which appear when various changes are made in only the size of the third coupling window 33 which adjusts coupling between the first and third resonators 11 and 13, without any change in the size of the first coupling window 31 which adjusts coupling between the first and second resonators 11 and 12 and the size of the second coupling window 32 which adjusts coupling between the second and third resonators 12 and 13.

When the third coupling window 33 is of varying sizes as mentioned above, it has been observed that the smaller third coupling window 33, that is, weaker coupling between the first and third resonators 11 and 13, allows the attenuation pole to shift in the direction of the arrow in FIG. 4 (i.e., toward higher frequencies) and gradually move farther away relative to the pass band of frequencies, as shown in FIG. 4. A noticeable feature is that little effect is exerted on the pass band of frequencies in spite of the shift of the frequency at which the attenuation pole is formed. Therefore, adjustment of coupling using the coupling windows 31 to 33 enables control of only a frequency band in which the attenuation pole is formed, while causing little change in the pass band of frequencies.

Figure 5:
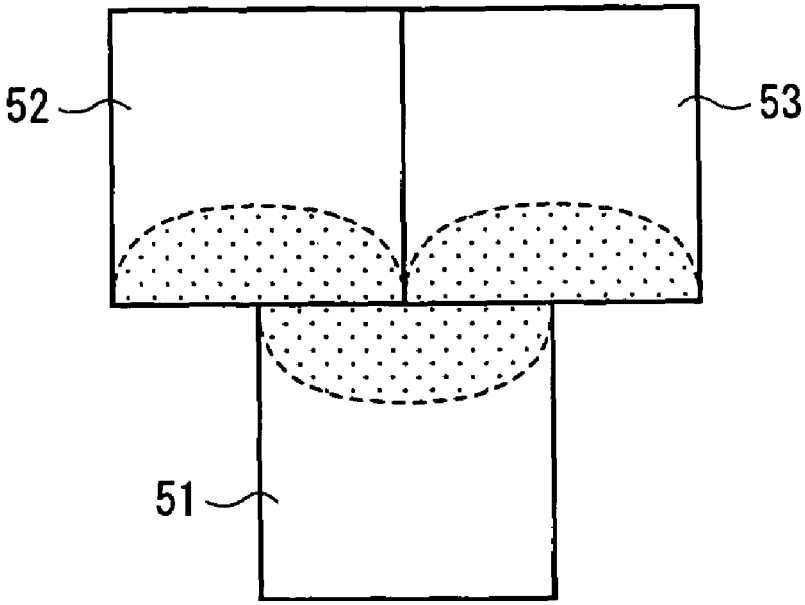
FIG. 5 is an illustration for explaining the strength of coupling of a T-shaped structure.

Next, the description is given with regard to the relation between the shapes and coupling of the resonators 11 to 13. There will be discussed the case where rectangular resonators 51 to 53 are coupled in the shape of the letter T as shown in FIG. 5, for example. In this case, near the coupling portions, the distribution of magnetic field strength in the H plane (i.e., a plane parallel to a magnetic field) in, for example, the lowest-order mode takes place as shown by the hatch pattern in FIG. 5. More specifically, in each of the resonators 51 to 53, the magnetic field strength is high at the center of the sidewall and is lower closer to the periphery thereof. Strong coupling of the resonators 51 to 53 requires coupling of the resonators to one another at their parts having high magnetic field strength.

When the rectangular resonators 51 to 53 are coupled in the shape of the letter T as shown in FIG. 5, the resonators 51 to 53, however, cannot be coupled at the parts having high magnetic field strength. This results in weak coupling of the resonators 51 to 53.

Figure 6:
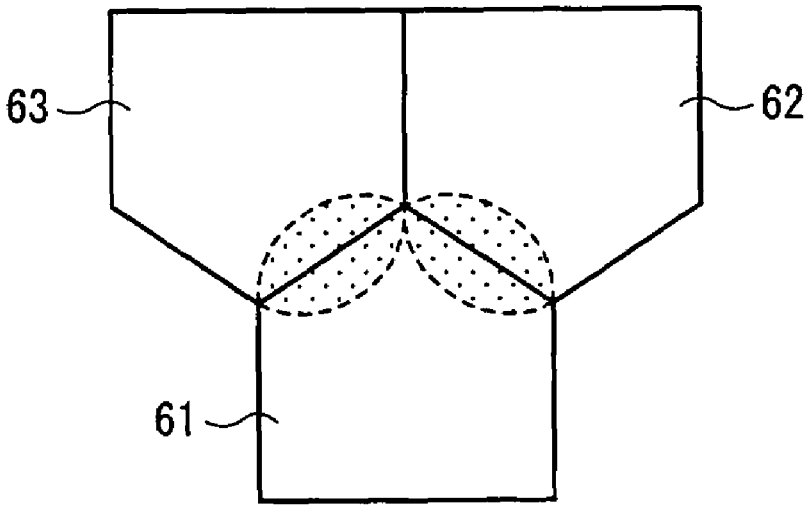
FIG. 6 is an illustration for explaining the strength of coupling of a Y-shaped structure.

On the other hand, there will be discussed the case where pentagonal resonators 61 to 63 are coupled in the shape of the letter Y as shown in FIG. 6, for example. In FIG. 6, the hatch pattern shows the distribution of magnetic field strength, as in FIG. 5. In the case of this structure, the resonators 61 to 63 can be coupled in such a manner that the parts having high magnetic field strength coincide with each other. This permits strong coupling of the resonators 61 to 63. In the case of the structure shown in FIG. 1, the coupling portions have the shape of the letter Y, so that the resonators 11 to 13 can be strongly coupled with efficiency, as in the case of the structure shown in FIG. 6.

As described above, in the embodiment, the resonators 11 to 13 each comprise the waveguide but have the structure including the parallel arrangement of two electromagnetic wave propagation paths, so that this structure, enables forming the attenuation pole and thus achieving excellent frequency characteristics. Moreover, the coupling portions of the resonators 11 to 13 (i.e., the boundaries thereof have the shape of the letter Y, thus enabling efficient coupling.

[Modifications]

Next, the description is given with regard to modifications of the filter and the method of arranging resonators according to the embodiment of the invention.

[First Modification]

Although the filter shown in FIG. 1 includes the three resonators 11 to 13 coupled so as to form the two signal propagation paths 41 and 42, the number of coupled resonators may be four or more. Three or more signal propagation paths may be formed. By referring to a first modification, the description is given with regard to such a configuration of a filter including four resonators coupled.

Figure 7:
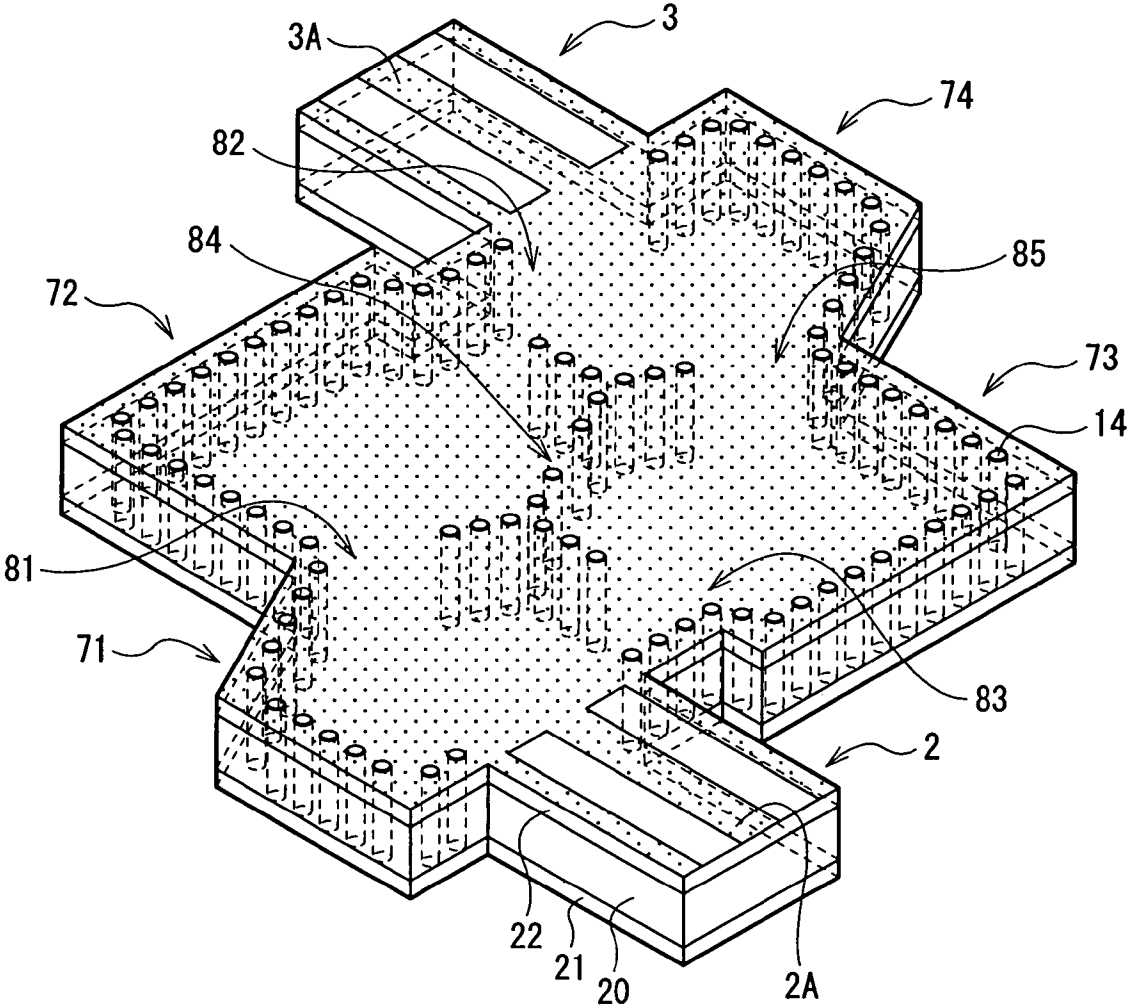
FIG. 7 is a perspective view showing a filter having a four-stage structure according to a first modification of the filter of the embodiment of the invention.
Figure 8:
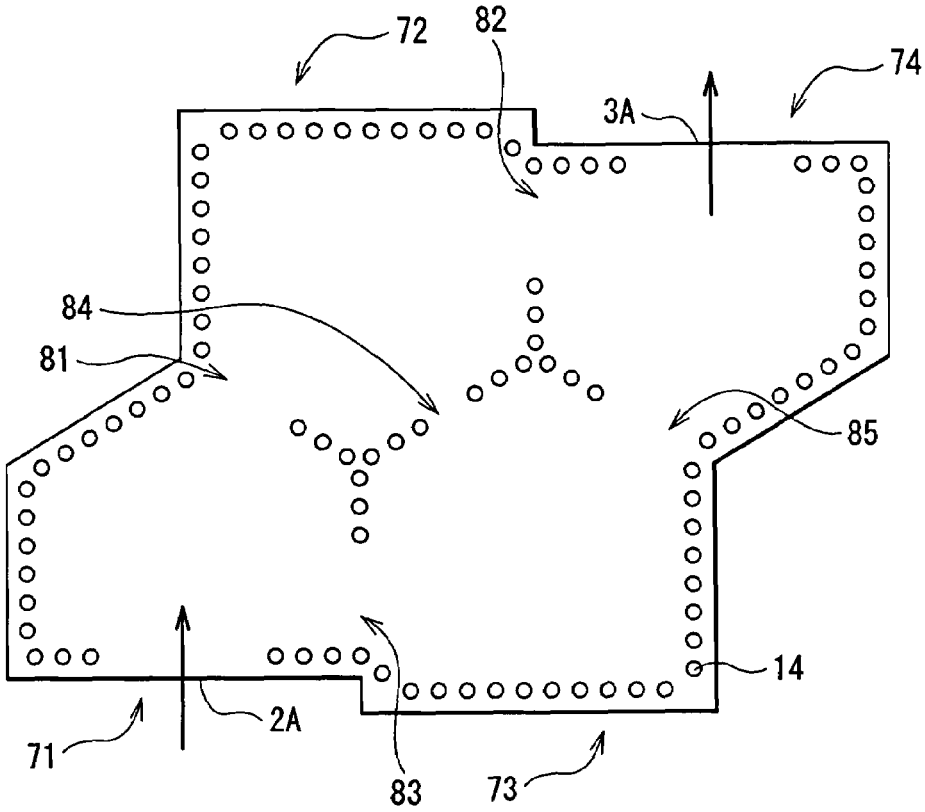
FIG. 8 is a schematic illustration for explaining the coupling of resonators of the filter shown in FIG. 7.

FIG. 7 shows the general configuration of a filter according to the first modification. In FIG. 8, there is schematically shown the arrangement and coupling of resonators constituting the filter. The filter comprises a four-stage filter including four resonators 71 to 74 coupled. The structures of the signal input 2 and signal output 3 and the structures of the resonators 71 to 74 are basically the same as those of the filter shown in FIG. 1.

The coupling structures of the resonators 71 to 74 are also basically the same as those of the filter shown in FIG. 1, and the branched structures of the coupling portions have the shape of the letter Y. For example, the coupling structures of the first, second and third resonators 71, 72 and 73 have the shape of the letter Y. The coupling structures of the second, third and fourth resonators 72, 73 and 74 also have the shape of the letter Y. In the coupling portions of the resonators 71 to 74, there are provided coupling windows 81 to 85, and the resonators 71 to 74 are electromagnetically connected to one another through the coupling windows 81 to 85.

Figure 9:
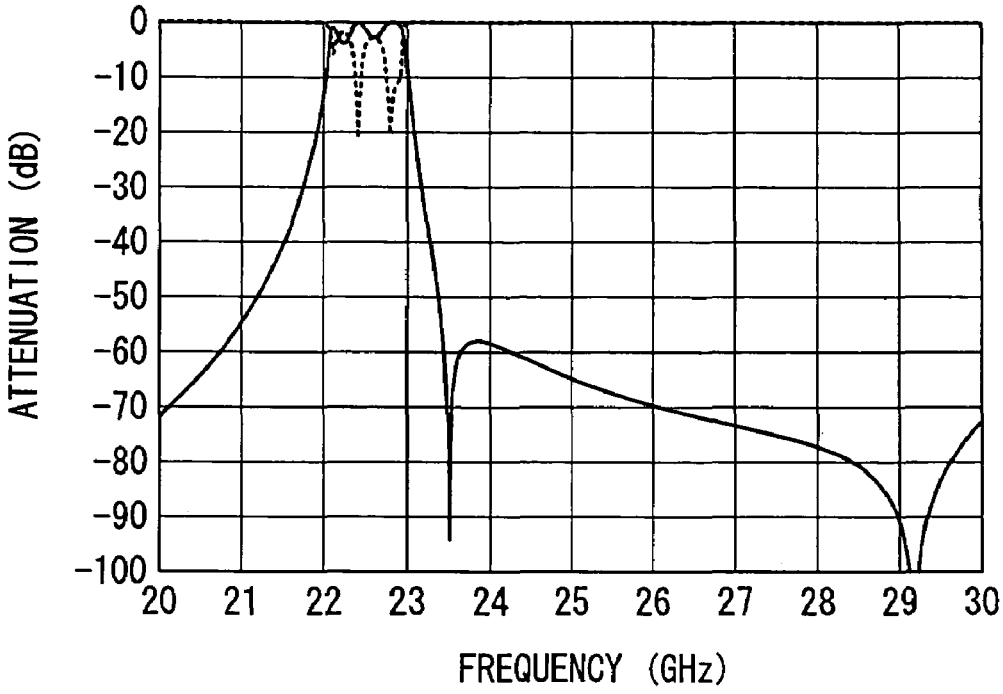
FIG. 9 is a plot showing frequency characteristics of the filter shown in FIG. 7.

FIG. 9 shows an example of actual frequency characteristics of the filter. The solid line indicates signal pass characteristics, and the dotted line indicates signal reflection characteristics. The vertical axis represents attenuation (dB), and the horizontal axis represents frequencies (GHz). In the case of this filter, it can be seen that an increase in the number of resonators and the number of signal propagation paths yields two attenuation poles.

As described above, in the first modification, an increase in the number of coupled resonators permits increasing the number of propagation paths and thus increasing the number of attenuation poles, thereby achieving more excellent frequency characteristics.

[Second Modification]

Figure 10:
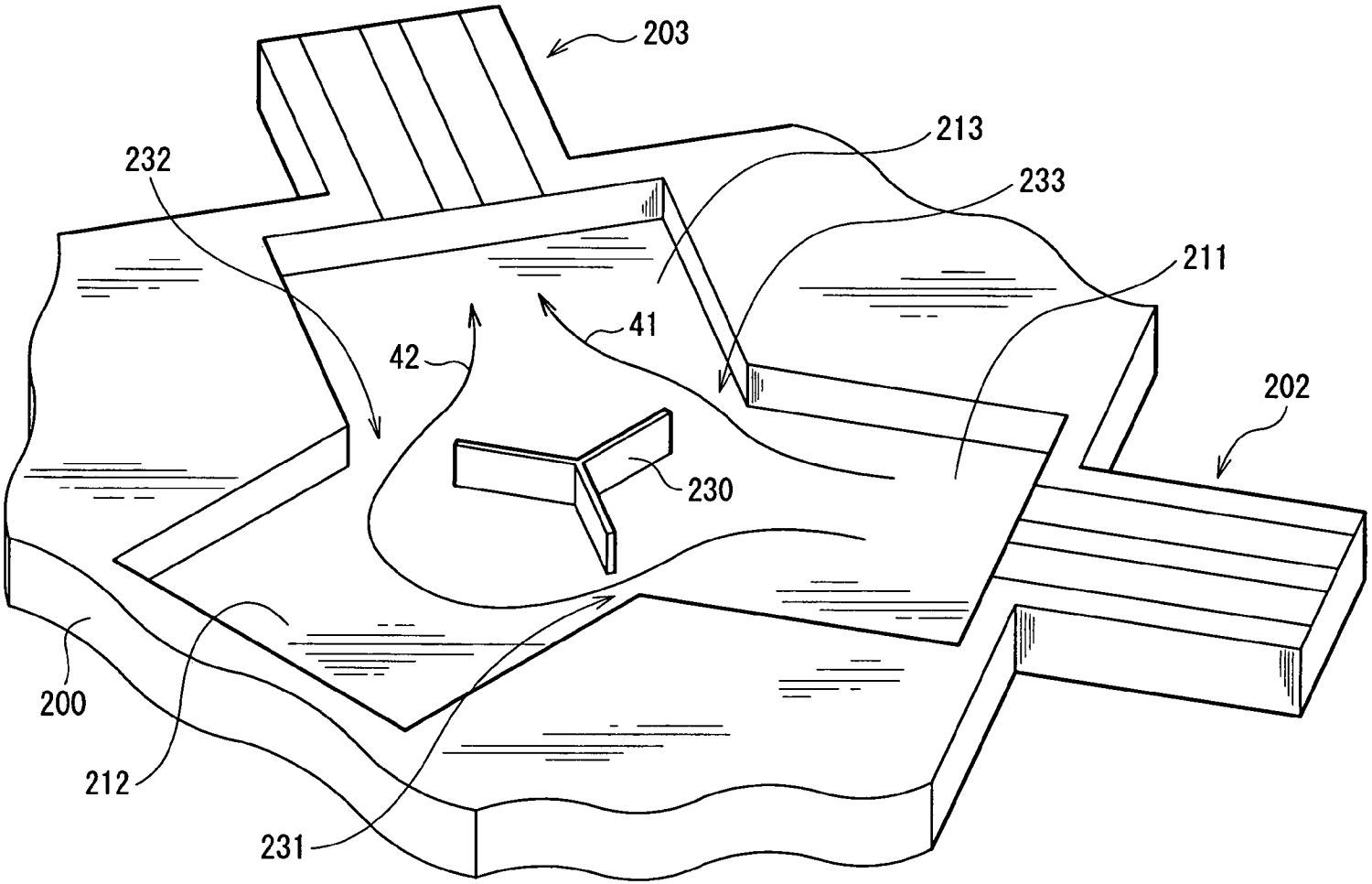
FIG. 10 is an illustration for explaining a filter according to a second modification of the filter of the embodiment of the invention.
Figure 11:
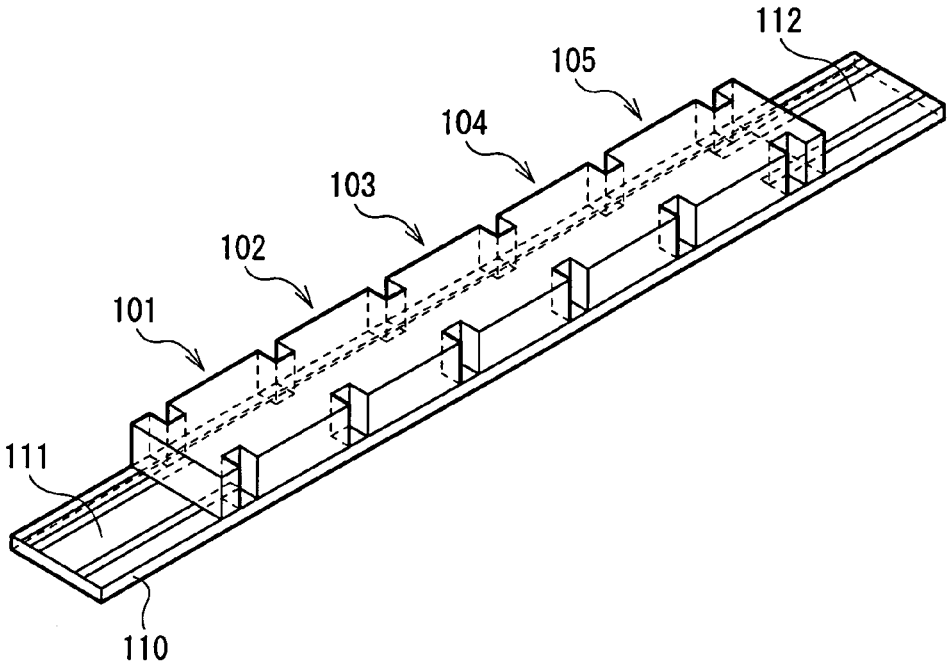
FIG. 11 is a perspective view showing a configuration of a conventional filter.
Figure 12:
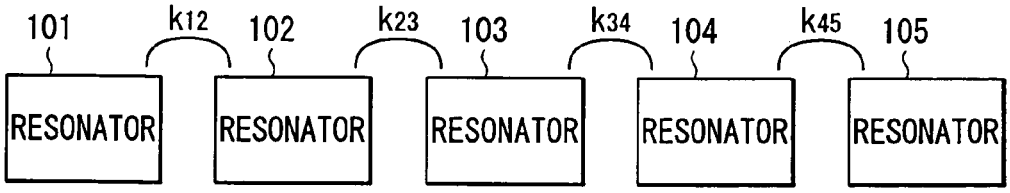
FIG. 12 is an explanatory diagram showing the coupling of resonators of the conventional filter.
Figure 13:
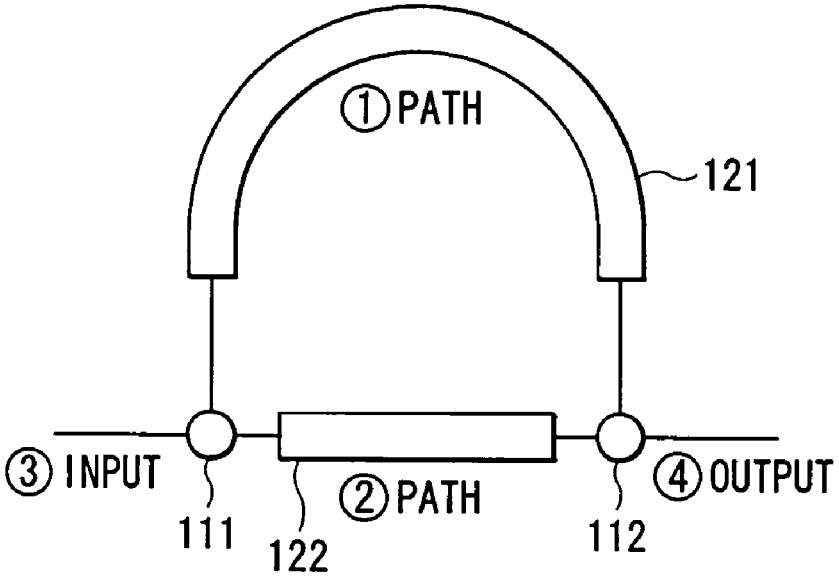
FIG. 13 is an explanatory illustration of the concept of a filter capable of producing an attenuation pole.

Although the through holes 14 are used to form the resonators 11 to 13 in the configuration shown in FIG. 1, the resonators may be formed without the use of the through holes 14. By referring to a second modification, the description is given with regard to a filter having such a structure. FIG. 10 is an illustration for explaining the configuration of a filter according to the second modification. For convenience of explanation, the actual structure of the filter is simplified in FIG. 10. For example, although not shown, the filter actually has the general structure of a waveguide filter including conductive layers in sheet form, which are stacked on a top surface of the filter.

In the filter, the sidewalls of resonators 211 to 213 are formed by a continuous conductive wall, as distinct from the sidewalls using the through holes 14. The resonators 211 to 213 are electromagnetically connected to one another through coupling windows 231 to 233 in the same manner as the resonators 11 to 13 of the filter shown in FIG. 1. In the coupling portions of the resonators 211 to 213 (i.e., the boundaries thereof, there is formed a conductive wall 230 upstanding in the shape of the letter Y. The above-mentioned structure can be manufactured through, for example, the process which involves hollowing out a dielectric substrate 200 in the shapes of the resonators 211 to 213 by use of micromachining or the like, and metallizing the hollowed surface. Alternatively, a substrate made of metal may be worked in the shapes of the resonators.

The function of the filter of the second modification is the same as that of the filter shown in FIG. 1. More specifically, an electromagnetic wave signal is inputted to a signal input 202 and enters into the first resonator 211, and the inputted electromagnetic wave signal propagates through the resonators along the two propagation paths 41 and 42. After propagating through the resonators along the two propagation paths 41 and 42, the electromagnetic wave signal exits from the third resonator 213 and is outputted from a signal output 203. The presence of the two propagation paths 41 and 42 causes a phase difference between electromagnetic waves propagating along the propagation paths 41 and 42, thus forming the attenuation pole.

The invention is not limited to the above-described embodiments, and various modifications of the invention are possible. By referring to the aforementioned embodiments, the description has been given with regard to the filter in which a plurality of resonators are arranged in two dimensions so as to form a plurality of propagation paths. However, for example, a plurality of resonators may be arranged in three dimensions so as to form a plurality of propagation paths. More specifically, for example, the filter shown in FIG. 1 may have a structure in which additional resonators are coupled along the height (i.e., in the upward or downward direction).

As described above, according to the filter of the invention or the method of arranging resonators of the invention, the resonators are arranged so that the electromagnetic wave enters through the input end into one of the resonators and exits through the output end from another resonator, and the resonators are arranged so that a plurality of propagation paths are formed between the input end and the output end. This enables forming the attenuation pole, thus achieving excellent frequency characteristics.

The filter of the invention includes at least three resonators arranged adjacent to one another, and a plurality of adjacent resonators are arranged in the general shape of the letter Y, and moreover the boundaries of the resonators have the general shape of the letter Y. In this case, the resonators can be coupled in such a manner that the parts having high magnetic field strength coincide with each other. Accordingly, the resonators can be strongly coupled with efficiency.

Obviously many modifications and variations of the present invention are possible in the light of the above teachings. It is therefore to be understood that within the scope of the appended claims the invention may be practiced otherwise than as specifically described.

What is claimed is:

1. A filter including three or more resonators each comprising a waveguide having an electromagnetic wave propagation region surrounded by conductors, wherein the resonators are arranged so that an electromagnetic wave enters through an input end into one of the resonators and exits through an output end from another resonator, the resonators are arranged so that a plurality of propagation paths of the electromagnetic wave in TE mode are formed between the input end and the output end, and the resonators each have a plurality of portions, the plurality of portions each including a rectilinear side in a cross section parallel to an H-plane, the resonators are arranged so that a rectilinear side of one resonator is shared with another resonator, the shared rectilinear sides form boundaries between resonators for electric and/or magnetic coupling between the resonators, and the boundaries between the resonators are in the general shape of the letter Y.

2. A filter according to claim 1, wherein the resonators are arranged in two dimensions along a plane containing the input end and the output end.

3. A filter according to claim 1, wherein the plurality of adjacent resonators are arranged in the general shape of the letter Y.

4. A filter according to claim 1, wherein each of the resonators has two conductive layers facing each other and sidewalls formed between the two conductive layers so that the electromagnetic wave in TE mode propagates through a region formed by the two conductive layers and the sidewalls, and the sidewalls of some or all of the resonators have branched structures, and a plurality of resonators are coupled at the branched parts.

5. A filter according to claim 4, wherein the sidewalls of the resonators having the branched structures have the shape of the letter Y.

6. A filter according to claim 4, wherein the sidewalls of the resonators are formed by through holes through and between the conductive layers.

7. A filter according to claim 4, wherein the sidewalls of the resonators are formed by a continuous conductive wall.

8. A filter according to claim 1, wherein the electromagnetic wave propagation region has a cavity structure.

9. A method of arranging three or more resonators each comprising a waveguide having an electromagnetic wave propagation region surrounded by conductors, including:

arranging the resonators so that an electromagnetic wave enters through an input end into one of the resonators and exits through an output end from another resonator;

arranging the resonators so that a plurality of propagation paths of an electromagnetic wave in TE mode are formed between the input end and the output end;

forming a plurality of portions for each resonator, each of the plurality of portions including a rectilinear side in a cross section parallel to an H-plane;

arranging the resonators adjacent one another so that the resonators share portions that include rectilinear sides; and forming boundaries between the adjacent resonators in the general shape of the letter Y, the boundaries formed by the shared rectilinear sides between the resonators for electric and/or magnetic coupling between the resonators.

10. A filter according to claim 1, wherein three resonators are arranged so that any one of the three resonators is adjacent to both of the other two of the three resonators, a first resonator of the three resonators has a first rectilinear side that is fully and exclusively shared with a second resonator of the three resonators, and a second rectilinear side that is fully and exclusively shared with a third resonator of the three resonators.

11. A filter according to claim 1, wherein three resonators are mutually adjacent to each other, any one of the three resonators has a first rectilinear side that is fully and exclusively shared with a first resonator of the rest two of the three resonators, and a second rectilinear side that is fully and exclusively shared with a second of the rest two of the three resonators.

* * * * *